US007124829B2

(12) United States Patent
Braddick

(10) Patent No.: US 7,124,829 B2
(45) Date of Patent: Oct. 24, 2006

(54) TUBULAR EXPANSION FLUID PRODUCTION ASSEMBLY AND METHOD

(75) Inventor: Britt O. Braddick, Houston, TX (US)

(73) Assignee: TIW Corporation, Houston, TX (US)

( * ) Notice: Subject to any disclaimer, the term of this patent is extended or adjusted under 35 U.S.C. 154(b) by 312 days.

(21) Appl. No.: 10/831,076

(22) Filed: Apr. 23, 2004

(65) Prior Publication Data

US 2004/0194972 A1 Oct. 7, 2004

Related U.S. Application Data

(63) Continuation-in-part of application No. 10/215,167, filed on Aug. 8, 2002, now Pat. No. 6,814,143.

(51) Int. Cl.
*E21B 33/10* (2006.01)

(52) U.S. Cl. ..... 166/382; 166/115; 166/206; 166/387

(58) Field of Classification Search ..... 166/382, 166/387, 115, 206, 207, 277
See application file for complete search history.

(56) References Cited

U.S. PATENT DOCUMENTS

| | | | | |
|---|---|---|---|---|
| 3,746,091 | A * | 7/1973 | Owen et al. | 166/107 |
| 3,776,307 | A | 12/1973 | Young | |
| 3,948,321 | A | 4/1976 | Owen | |
| 4,083,408 | A * | 4/1978 | Milam | 166/387 |
| 4,967,844 | A | 11/1990 | Brooks et al. | |
| 5,267,617 | A | 12/1993 | Perricone et al. | |
| 5,307,879 | A * | 5/1994 | Kent | 166/382 |
| 5,333,692 | A | 8/1994 | Baugh | |
| 5,348,095 | A | 9/1994 | Worrall et al. | |
| 5,366,012 | A | 11/1994 | Lohbeck | |
| 5,390,742 | A | 2/1995 | Dines et al. | |
| 5,494,106 | A | 2/1996 | Gueguen et al. | |
| 5,511,620 | A * | 4/1996 | Baugh et al. | 166/387 |
| 5,613,560 | A | 3/1997 | Jelinski et al. | |
| 5,667,011 | A | 9/1997 | Gill et al. | |
| 5,738,171 | A | 4/1998 | Szarka | |
| 5,785,120 | A | 7/1998 | Smalley et al. | |
| RE36,525 | E | 1/2000 | Pringle | |
| 6,021,850 | A | 2/2000 | Wood et al. | |
| 6,041,858 | A | 3/2000 | Arizmendi | |
| 6,050,341 | A | 4/2000 | Metcalf | |
| 6,250,385 | B1 | 6/2001 | Montaron | |
| 6,598,677 | B1 * | 7/2003 | Baugh et al. | 166/285 |
| 6,622,789 | B1 * | 9/2003 | Braddick | 166/277 |
| 6,789,622 | B1 * | 9/2004 | Ducasse et al. | 166/277 |
| 6,814,143 | B1 * | 11/2004 | Braddick | 166/277 |
| 2002/0020532 | A1 | 2/2002 | Wagg | |
| 2005/0178561 | A1 * | 8/2005 | Gazewood | 166/380 |

* cited by examiner

*Primary Examiner*—Hoang Dang
(74) *Attorney, Agent, or Firm*—Browning Bushman P.C.

(57) ABSTRACT

An expansion-set fluid production assembly transfers well fluids from a casing string 12 to a production tubing string 112. A tubular anchor 72 and tubular expander 70 may be positioned downhole on a running tool at a desired depth along the casing string 12. An actuator assembly 10 may forcibly move the tubular expander 70 into the tubular anchor 72, expanding the tubular anchor 72 to seal and secure the tubular anchor 72 against the casing string 12. The running tool actuator assembly 10 may be removed, leaving the expanded tubular anchor 72 and tubular expander 70 downhole. A seal nipple 122 may be sealed with the tubular expander 70 and to the production tubing string 112. Fluids may then be recovered from the wellbore through the casing string 12, through the fluid production assembly, and into the production tubing string 112.

34 Claims, 4 Drawing Sheets

TUBULAR EXPANSION FLUID PRODUCTION ASSEMBLY AND METHOD

RELATED CASE

This invention is a continuation-in-part of U.S. Ser. No. 10/215,167 filed Aug. 8, 2002, now U.S. Pat. No. 6,814,143 entitled Downhole Tubular Patch, Tubular Expander and Method and hereby incorporated herein by reference, and which is a continuation-in-part of U.S. Pat. No. 6,622,789.

FIELD OF THE INVENTION

The present invention relates to downhole tools and techniques used to radially expand a portion of a downhole tubular into sealing engagement with a surrounding tubular. More particularly, this invention relates to a technique for forming a fluid production assembly or a downhole tubular patch inside a perforated or separated tubular.

BACKGROUND OF THE INVENTION

Oil well operators have long sought improved techniques for forming a fluid production assembly to seal with a casing string and transmit fluid through a production string to the surface. Most fluid production assemblies seal with a casing string and transmit fluid from the casing string to a production tubing string using a production packer. The production packer seals with the casing string, so that formation fluid flows into the casing string, through the central bore of the production packer, then into the production tubing string which continues to the surface. Various types of production packers have been devised to fulfill this purpose, including those disclosed in U.S. Patents Re 36,525; U.S. Pat. Nos. 4,967,844; 5,267,617; 5,613,560; and 5,738,171.

Also, operators have long desired improved techniques for forming a downhole patch across a tubular which has lost sealing integrity, whether that be due to a previous perforation of the tubular, high wear of the tubular at a specific downhole location, or a complete separation of the tubular. There are times when a screened section of a tubular needs to be sealed off. A tubular patch with a reduced throughbore may then be positioned above and below the zone of the large diameter tubular which lost its sealing integrity, and the reduced diameter tubular then hung off from and sealed at the top and bottom to the outer tubular. In some applications, the patch may be exposed to high thermal temperatures which conventionally reduce the effectiveness of the seal between the tubular patch and the outside tubular. In heavy oil recovery operations, for instance, steam may be injected for several days, weeks or months through the tubular, downward past the patch, and then into a formation.

U.S. Pat. No. 5,348,095 discloses a method of expanding a casing diameter downhole utilizing a hydraulic expansion tool. U.S. Pat. No. 6,021,850 discloses a downhole tool for expanding one tubular against a larger tubular or the borehole. Publication U.S. 2001/0020532 A1 discloses a tool for hanging a liner by pipe expansion. U.S. Pat. No. 6,050,341 discloses a running tool which creates a flow restriction and a retaining member moveable to a retracted position to release by the application of fluid pressure. U.S. Pat. No. 6,250,385 discloses an overlapping expandable liner. A sealable perforating nipple is disclosed in U.S. Pat. No. 5,390,742, and a high expansion diameter packer is disclosed in U.S. Pat. No. 6,041,858. U.S. Pat. No. 5,333,692 discloses seals to seal the annulus between a small diameter and a large diameter tubular. U.S. Pat. No. 3,948,321 discloses a liner with a reinforcing swage which remains downhole when the tool is retrieved to the surface.

Due to problems with the procedure and tools used to expand a smaller diameter tubular into reliable sealing engagement with a larger diameter tubular, many tools have avoided expansion of the tubular and used radially expandable seals to seal the annulus between the small diameter and the large diameter tubular, as disclosed U.S. Pat. No. 5,333,692. Other patents have suggested using irregularly shaped tubular members for the expansion, as disclosed in U.S. Pat. Nos. 5,366,012, 5,494,106, and 5,667,011. U.S. Pat. No. 5,785,120 discloses a tubular patch system with a body and selectively expandable members for use with a corrugated liner patch. U.S. Pat. No. 6,250,385 discloses an overlapping expandable liner. A sealable perforating nipple is disclosed in U.S. Pat. No. 5,390,742 and a high expansion diameter packer is disclosed in U.S. Pat. No. 6,041,858.

Various hydraulic expansion tools and methods have been proposed for expanding an outer tubular while downhole. While some of these tools have met with limited success, a significant disadvantage to these tools is that, if a tool is unable to continue its expansion operation (whether due to the characteristics of a hard formation about the tubular, failure of one or more tool components, or otherwise), it is difficult and expensive to retrieve the tool to the surface to either correct the tool or to utilize a more powerful tool to continue the downhole tubular expansion operation. Accordingly, various techniques have been developed to expand a downhole tubular from the top down, rather than from the bottom up, so that the tool can be more easily retrieved.

The disadvantages of the prior art are overcome by the present invention.

SUMMARY OF INVENTION

A fluid production assembly is provided for sealing with a casing string and transmitting fluids between the casing string and a production string. The fluid production assembly includes a tubular anchor removably supported on a running tool, a tubular expander for expanding the tubular anchor into engagement with the casing string, and a sealing sleeve secured to an upper end of the tubular expander. A seal nipple for sealing with the bore of the sealing sleeve is provided for fluidly connecting the tubing member and the production string or patch liner. An improved system is also disclosed for forming a patch in a well at a location along the downhole tubular string where fluid containment is required. The system includes a tubular patch with a central patch body, an upper expander body, and a lower expander body, and a running tool to move the tubular patch into sealing engagement with the downhole tubular string. The present invention also discloses a method which may be reliably used to set the lower patch, seal the central patch body to the lower patch, then set the upper patch.

In one embodiment, a system for forming a tubular patch in a well includes a patch for positioning within a downhole tubular string at a location that has lost sealing integrity. The tubular patch preferably includes a central patch body having a generally cylindrical central interior surface, a lower tubular anchor having a generally cylindrical interior surface and one or more exterior seals and slips, and an upper tubular anchor having generally cylindrical interior surfaces and one or more exterior seals and slips. A sleeve shaped expander forces each anchor radially outward into sealing engagement with the casing, and remains within the anchor to provide substantial radial support. The running tool preferably includes one or more pistons each axially movable relative to an inner mandrel in response to fluid pressure within the running tool.

In another embodiment, a fluid production assembly is provided for use downhole in a hydrocarbon recovery wellbore. A sleeve shaped anchor member of the fluid production assembly expands to seal with a casing string and a sleeve shaped expander remains interior of the anchor to provide substantial radial support. The expander also includes an upwardly facing sealing sleeve, so that the assembly may then transmit fluid from the casing string to a production string sealed to a seal nipple and extending upward from the fluid production assembly to the surface. The fluid production assembly preferably includes both a tubular anchor and a tubular expander for forcibly expanding the tubular anchor. The assembly provides full bore capability, with the ID of the expander substantially coinciding with the ID of the production string.

The tubular anchor and the tubular expander may thus be removably supported on a running tool for positioning downhole at a desired depth within the casing string. The tubular anchor has an initial anchor inner diameter, and the tubular expander has a substantially cylindrical expander outer surface with a diameter greater than the initial anchor inner diameter, such that forcibly moving the expander within the tubular anchor will expand the tubular anchor. A hydraulic actuator may be provided for forcibly moving the tubular expander. By forcing the tubular expander into the tubular anchor and expanding the tubular anchor against the casing string, the tubular anchor and tubular expander may be secured in place and remain downhole. A patch may be formed by expanding an upper anchor member at the upper end of a liner or other patch body after the lower anchor is set.

A related method is provided for transferring downhole fluid from a casing string to a production string, or for providing fluid isolation to one or more zones at a selected depth. The tubular anchor may be positioned downhole in the casing string using a running tool. The tubular expander may then be forcibly moved and positioned within the tubular anchor to radially expand the tubular anchor against the casing string, sealing the tubular anchor with the casing string. The running tool may be removed from the tubular anchor and the tubular expander, which may remain in place downhole. A seal nipple may then be sealed with a sealing sleeve connected to the tubular expander, with the seal nipple being in fluid communication with the production string. Fluid may thus be transferred from the formation to the casing string, through the seal nipple, and through the production string to the surface. Alternatively, an upper anchor may be sealed to the casing string with an upper expander, thereby forming a reliable patch.

It is a feature of the invention that the tool for setting the patch in the wellbore need not have a substantial stroke length, since the stroke length need be no longer than the longer of the axial length of the lower anchor or the axial length of the upper anchor.

In a preferred embodiment, the expander system includes an expander setting sleeve with a uniform diameter outer surface for expanding the anchor, with the sleeve-shaped expander setting sleeve remaining downhole to provide radial support for the anchor that was expanded.

The tubular expander may include an integral upwardly extending sealing sleeve. The seal nipple may include one or more annular radially outward metal bumps for forming a metal-to-metal seal with the sealing sleeve, and optionally an elastomeric seal for sealing with the sealing sleeve. The sealing sleeve may include a polished cylindrical surface for sealing with the nipple. Metal to metal ball seals may also be provided on the outer surface of the tubular expander for sealing within the anchor. A plurality of slips may be positioned on the tubular anchor for expanding with the tubular anchor to secure the tubular anchor to the casing string upon expansion of the tubular anchor.

Yet another feature is that the tubular expander may include a tapered end to facilitate positioning the tubular expander within the tubular anchor. The tapered end may thus be positioned slightly within the tubular anchor, then the tubular expander axially moved to be substantially within the tubular anchor, thereby expanding the tubular anchor. An end surface of the tubular anchor may be tapered for receiving the tubular expander. The main body of the tubular expander is preferably not tapered, however, and has a substantially cylindrical inner surface with annular ball seals thereon.

Yet another feature is that the running tool may be easily and reliably released from the fluid production assembly after expansion of the tubular anchor. An interference fit between the tubular expander and the tubular anchor secures the tubular expander within the tubular anchor. The running tool may then be removed from the well.

A significant feature of the invention is that the lower patch body may be run in a well, set by expanding the anchor, and sealing integrity between the lower anchor and the casing tested before running the liner or central patch body and the upper patch body in the well. The same setting tool may be used to set the lower anchor and the upper anchor, and the stroke of the tool may be substantially reduced compared to a setting tool which simultaneously sets both the lower patch body and the upper patch body.

Another feature of the invention is that the receptacle formed by the expander sealing sleeve and the seal nipple functions as an expansion joint to allow for thermal expansion and compression of the production string or the liner between the lower patch body and the upper patch body. Extremely long liner lengths may be utilized since the upper and lower patch bodies are individually set. Additional patch systems may also be extended uphole by the upper setting sleeve on the upper expander body forming the receptacle for another seal nipple, with another patch then extending upward from the upper patch body.

An advantage of this invention is that a fluid production assembly may be set downhole in the casing string more reliably than prior art fluid production assemblies. The fluid production assembly may be set by simply expanding the tubular anchor. Forcibly expanding the tubular anchor against the casing string seals the tubular anchor with the casing string, and may also secure the tubular anchor and the tubular expander downhole within the casing string.

Another advantage of this invention is the fluid production assembly may be constructed more economically than other fluid production assemblies. The assembly may consist of few components. A related advantage is that many components of the assembly, such as slips and/or packer seals, may be commercially available for use with various downhole conditions.

It is a significant advantage of this invention is that the system for forming a patch in a well may utilize conventional components each with a high reliability. Also, existing personnel with a minimum of training may reliably use the system according to the present invention, since the invention relies upon utilizing well-known surface operations to reliably form the downhole patch.

These and further features and advantages of the present invention will become apparent from the following detailed description, wherein reference is made to the figures in the accompanying drawings.

DETAILED DESCRIPTION OF THE PREFERRED EMBODIMENT

Figure 1A:
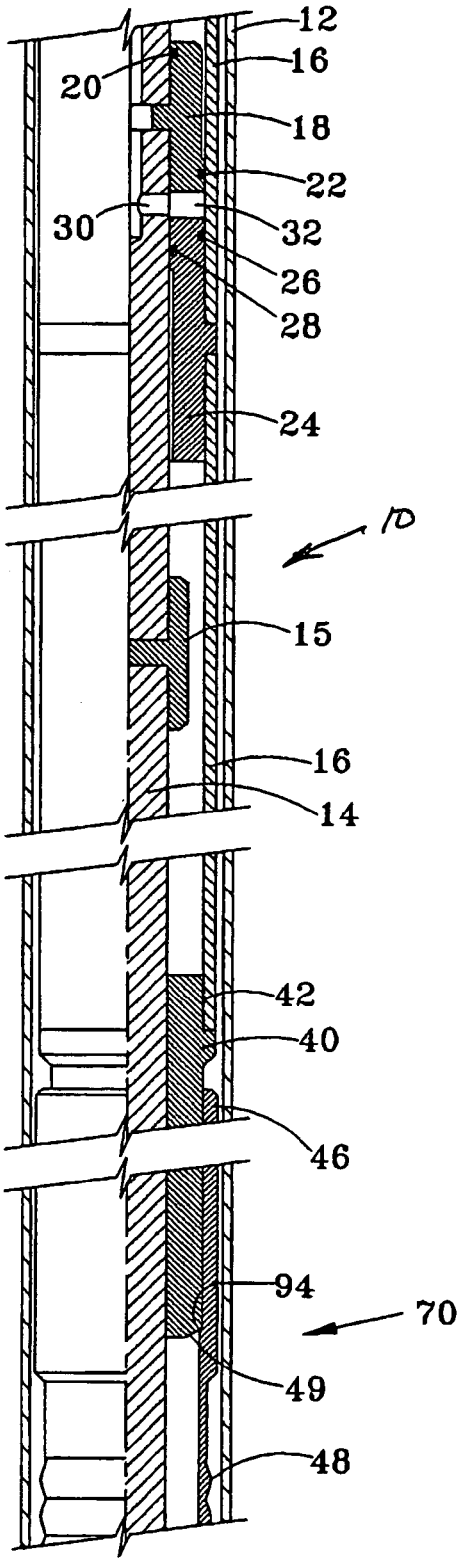
FIG. 1A shows a hydraulic setting portion of a suitable setting tool.
Figure 1B:
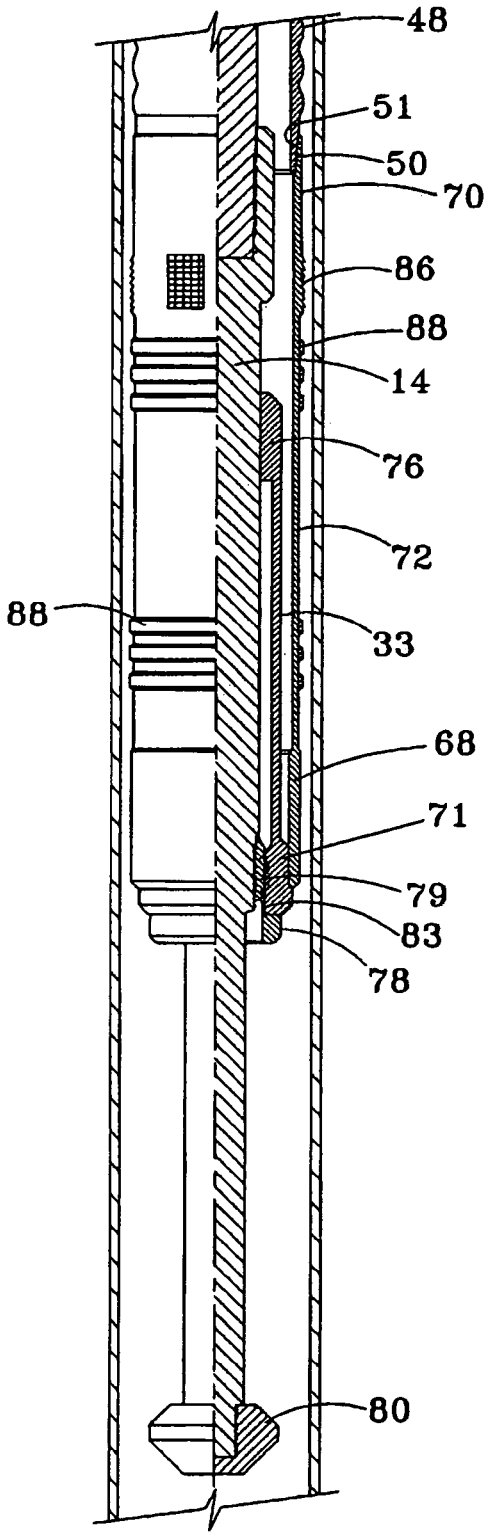
FIG. 1B shows a lower portion of a setting tool as run in a well, including a tubular anchor and a tubular expander on the running tool.

FIGS. 1A and 1B disclose a preferred system for setting a tubular anchor in a well at a selected location along a downhole tubular string that has lost sealing integrity. The actuator assembly 10 may be suspended in a well from the work string, and positioned at a desired depth within the casing string 12. The system of the present invention may position a tubular patch within the downhole casing string at a location that has lost sealing integrity or where fluid containment is otherwise desired, or may form a fluid production assembly for transmitting fluid to a production string. FIGS. 1A–1B thus depict components of the running tool actuator assembly, and also a tubular anchor and a tubular expander for forming either a lower patch seal of a fluid production assembly for sealing with the casing, or a seal with the casing for cooperation with a production tubing string of a fluid production assembly.

The upper end of the running tool actuator assembly 10 may include an inner connector or seal body 18 structurally connected by threads to the running tool inner mandrel 14, which in turn is structurally connected to a work string. A throughport 30 in the mandrel 14 below the inner seal body 18 allows fluid pressure within the interior of the running tool to act on an outer connector or seal body 24, which as shown includes conventional seals 26, 28 for sealing between the mandrel 14 and an outer sleeve 16. A predetermined amount of fluid pressure within the running tool acting on the outer seal body 24 will thus provide downward movement of the outer sleeve 16.

Fluid pressure to the inner seal body 18 passes through the throughport 30, and inner seal body 18 is sealed to mandrel 14 and sleeve 16 by seals 20 and 22. Fluid pressure thus exerts an upward force on the seal body 18 and thus the mandrel 14, and also exerts a downward force on the outer sleeve 16 transmitted through to the outer seal body 24. Those skilled in the art will appreciate that a series of outer seal bodies, inner seal bodies, sleeves and mandrels may be provided, so that forces effectively "stack" to create the desired expansion forces. It is a particular feature of the present invention that a series of inner and outer connectors may exert a force on the tubular expander in excess of 100,000 pounds of axial force, and preferably in excess of about 150,000 pounds of axial force, to expand the tubular anchor and effect release of the running tool from the expanded anchor. The lower end of a tubular patch may be set by seating a ball or other plug on a seat collar and increasing fluid pressure in cavity 32 to activate the plurality of piston within the running tool to develop the required compressive forces on the tubular expander sleeve to expand the tubular anchor.

The upper seal body 18, lower seal body 24, sleeve 16, and running tool mandrel 14 define a variable size hydraulic cavity. The throughport 30 passing through the running tool mandrel 14 is in fluid communication with the hydraulic cavity 32. Thus, as fluid pressure is introduced from within the mandrel 14 through the port 30 and into the hydraulic cavity, the lower seal body 24 moves downward with respect to the upper seal body 18. With the upper seal body 18 fixed to the mandrel 14 and the lower seal body 24 fixed to the sleeve 16, fluid pressure introduced into the hydraulic cavity moves the sleeve 16 downward relative to the mandrel 14 to move the tubular expander 70 downward to expand the tubular anchor 72. Redundant or multiple sets of upper seal bodies, lower seal bodies, and hydraulic cavities may be provided, axially spaced apart along the mandrel 14 to assist hydraulic actuation.

FIG. 1A shows a representative portion of the running tool actuator assembly 10 for positioning the fluid production assembly downhole, and for forcibly moving the tubular expander 70 into the tubular anchor 72 to expand the tubular anchor 72. The running tool mandrel 14 may be assembled to a desired length from multiple tubular members, such as members 14 joined by tubular connectors 15. The hydraulic actuator assembly may include a sleeve 16 axially movable with respect to the running tool mandrel 14 and secured to the force transfer member 40 via a threaded connection 42.

The force transfer member 40 may be fixed to and move with the sleeve 16, so that the force transfer shoulder 49 on member 40 engages the shoulder 94 (see FIGS. 1A and 2) on the sealing sleeve 46 at the upper end of the tubular expander 70. Thus, by hydraulically moving the sleeve 16 downward, the tubular expander 70 is forcibly moved at least substantially within the tubular anchor 72 to expand the tubular anchor 72 into engagement with the casing string 12. The tubular force transfer member 40 as shown in FIG. 1A may thus be positioned above the tubular expander 70, and moves or strokes the tubular expander 70 downward. The tubular force transfer member 40 may also help maintain vertical alignment of the tubular expander 70 with the mandrel 14 prior to and during expansion.

Downward movement of tubular expander 70 thus expands the tubular anchor 72 and brings packing 88 and slips 86 into respective sealing and gripping engagement with the casing string 12. Axial movement is prohibited when shoulder 73 on expansion sleeve 70 (see FIG. 2) engages stop surface 52 at the upper and of tubular anchor 72 (see FIG. 3).

FIG. 1B also shows a portion of an expansion-set fluid production assembly supported downhole in a wellbore on a mandrel 14 of the actuator assembly 10. The assembly may be lowered in the wellbore at a selected depth within a casing string 12 prior to being set in the well. The casing string 12 may be assembled from multiple threaded tubular casing joints commonly used in hydrocarbon recovery operations, and the selected position or depth for the running tool mandrel 14 may be along any one of the undamaged casing joints.

Figure 3:
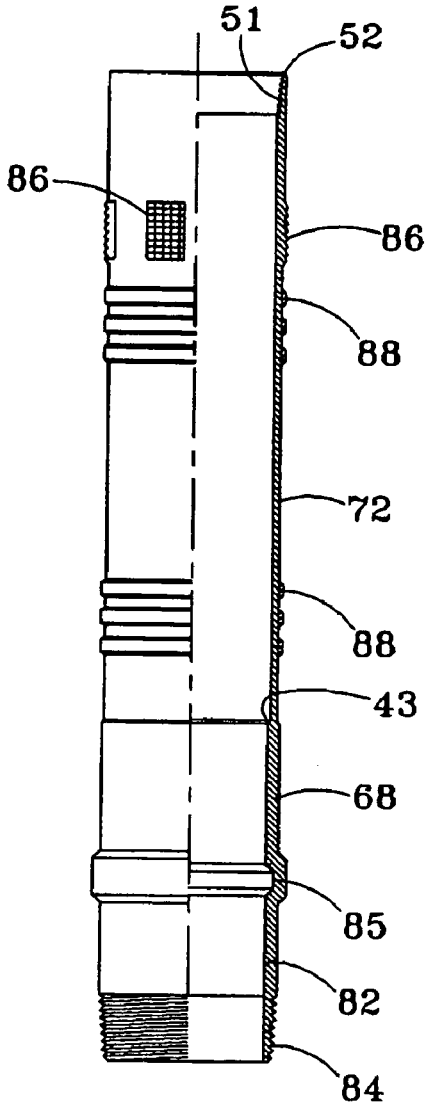
FIG. 3 illustrates an alternative tubular anchor with a lower end for receiving a tubular.

In the case of a patch, the central patch body in many applications may have a length of from several hundred feet to a thousand feet or more. The lower patch is set first, then the liner or central patch body sealed to the set lower patch, then the upper patch set. Preferably the seal with the lower patch and the casing is tested before the patch body or liner is installed so that another second patch can be set above a defective first patch, the second patch reliably tested, then the patch body installed on the second patch. Both the lower anchor body 72 and the upper anchor preferably have a generally cylindrical exterior surface and support one or more vertically spaced annular external seals 88 (see FIGS. 1B and 3) formed from a suitable seal material, including graphite. Graphite base packing forms a reliable seal with the casing string when the anchor bodies are subsequently expanded into sealing engagement with the casing. The tubular anchor 72 also preferably includes a plurality of respectively circumferential-spaced slips 86, as shown in FIGS. 1B and 3.

Figure 2:
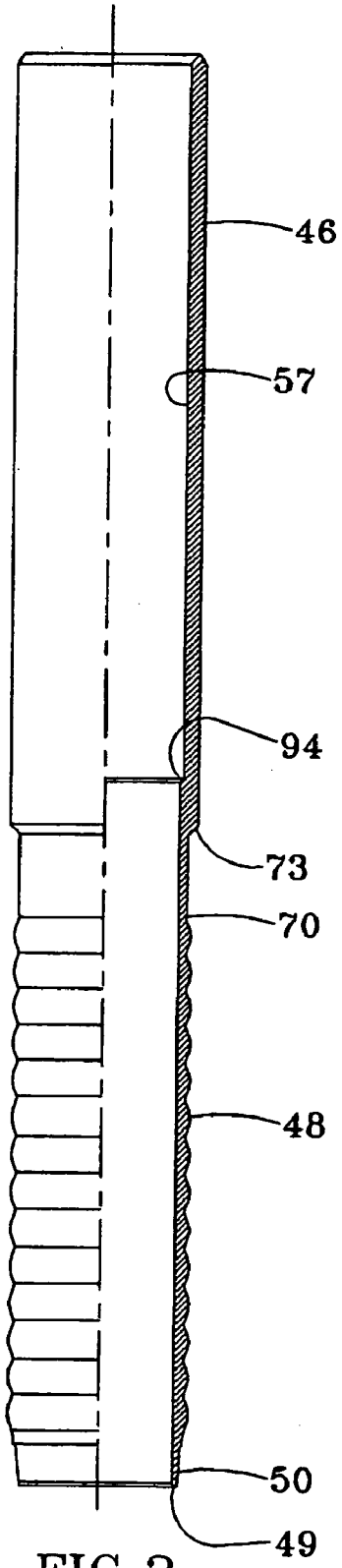
FIG. 2 illustrates in further detail a suitable tubular expander with an upper sealing sleeve.

The tubular expander 70 preferably is a continuous sleeve-shaped member which radially supports the tubular anchor 72 once expanded. The expander sleeve 70 may include a plurality of annular bumps 48 as shown in FIG. 2 which form metal to metal seals with the tubular anchor once expanded. The projecting bumps 48 thus act as metal to metal ball seals between the expander body and the expander sleeve.

After expanding the tubular anchor by engaging tubular expander inner shoulder 94 with force transfer shoulder 49 on member 40, fluid pressure in hydraulic cavity 32 increases the upward force on running tool mandrel 14 sufficient to break thin neck 83 (see FIG. 1B) of shear member 78. Stop 80 at bottom of running tool body 14 catches the broken lower part of shear member 78. The tool mandrel 14 is then free to move upward until the upper broken part of shear member 78 engages collet ring 76 to remove the tool from the fluid production assembly. As the running tool mandrel 14 is moved upward, the shear member 78 thus shears at the neck 83, so that the collet heads 71 at the lower end of fingers 33 move inward toward the running tool mandrel 14. The collet fingers 33 on the collet members 76 may then pass upward through the expanded tubular anchor 72 and the inner expander 70. The shear member 78, collet members 76, and other components of the running tool may then be removed from the wellbore, along with the actuator assembly 10.

In one embodiment, the tubular anchor 72 and the tubular expander 70 may be supported on the running tool mandrel 14 with a left-hand threaded connection. If for some reason the shear member 78 cannot be sheared, the actuator assembly 10 may alternatively be removed by unthreading the connection between 79 and 14 (see FIG. 1B). The left-hand threaded connection of 79 to 14 prevents undesirable unthreading of the tubular right-hand connections, which typically join tubulars and threaded components of downhole tools. A preferred running tool as disclosed herein may thus include a shear collar threaded to a running tool mandrel, with the shear collar having the ability to be disconnected from the mandrel by a left hand thread, while also having the ability to be sheared in response to the application of forces. Provision of the left hand thread backup enhances the reliability of the running tool in the event that, for some reason, sufficient forces could not be generated to shear the shear collar.

The fluid production assembly preferably includes a tubular anchor 72 and a tubular expander 70 positioned above the tubular anchor 72. The tubular expander 70 has an expander outer diameter greater than an anchor inner diameter, such that moving the tubular expander 70 into the tubular anchor 72 will expand the tubular anchor 72 against the casing string 12 to seal the tubular anchor 72 with the casing string 12 and secure the tubular anchor 72 and the tubular expander 70 downhole in the casing string 12. The tubular expander 70 may be positioned above and rest on the tubular anchor 72 prior to expansion, restraining axially downward movement of the tubular expander 70. The tubular anchor and expander are solid rather than perforated or slotted.

The expander setting sleeve 70 may include a tapered end surface 50, which engages a mating tapered surface 51 on the upper or lower anchor 72. An inward tapered end 50 of the tubular expander 70 thus preferably narrows to a diameter less than the anchor inner diameter, allowing the tapered end 50 to be at least partially inserted into an upper end 51 of the tubular anchor 72 prior to expansion of the tubular anchor 72. Once the expander sleeve 70 is moved axially into the anchor 72, the sleeve-shaped expander sleeve 70 will provide substantial radial support to the tubular anchor even after the running tool is returned to the surface. This increased radial support to the anchor 72 maintains fluid tight engagement between the tubular anchor and casing string. The running tool may then be retrieved with the expander sleeve 70 positioned radially inward of and axially aligned with the respective upper or lower tubular anchor to maintain the tubular anchor in gripping engagement with the casing string.

Those skilled in the art will appreciate that the patch of the present invention provides a highly reliable system for sealing within a casing, and is particularly designed for a system that experiences elevated temperature and pressure conditions that are frequently encountered in downhole thermal hydrocarbon recovery applications. A plurality of seals on each anchor are provided by metal to metal ball seals on the tubular expander. The sealing nipple to the sealing sleeve tie-back may also have metal-to-metal ball sealing capability.

FIG. 2 shows a partial cross-section of a suitable tubular expander 70, and FIG. 3 shows a partial cross-section of a suitable tubular anchor 72. The tubular expander 70 may include a plurality of axially spaced radial projections 48 or ball seals defining the expander outer diameter, which contact the anchor inner diameter during expansion. These provide multiple metal to metal seals in an interference fit between the tubular anchor 72 and the tubular expander 70. The OD and ID of the expander 70 is substantially constant along its length (except for the ball seals 48), thereby reducing the likelihood that the expander will slide out from under the set anchor after the running tool is retrieved to the surface. One or more packer seals 88 may be provided on the tubular anchor 72 for sealing with the casing string 12 upon expansion of the tubular anchor 72. A plurality of gripping members, such as slips 86, may be provided on the tubular anchor 72 for securing the tubular anchor 72 to the casing string 12 upon expansion of the tubular anchor 72. The lower end 68 of the tubular anchor as shown in FIG. 3 is connected to a lower sleeve 82, which includes an annular groove 85 for receiving the collet heads similar to those shown in FIG. 1, and threads 84 for mating connection to a tubular extending downward in the well from the anchor. An annular recess for receiving the collet of the running tool may be provided at the lower end of the anchor below the location of the lowest end of the expander within the anchor. In both embodiments, the lower end of the running tool preferably engages the tubular anchor while the expander is pushed downward into the tubular anchor.

Figure 5:
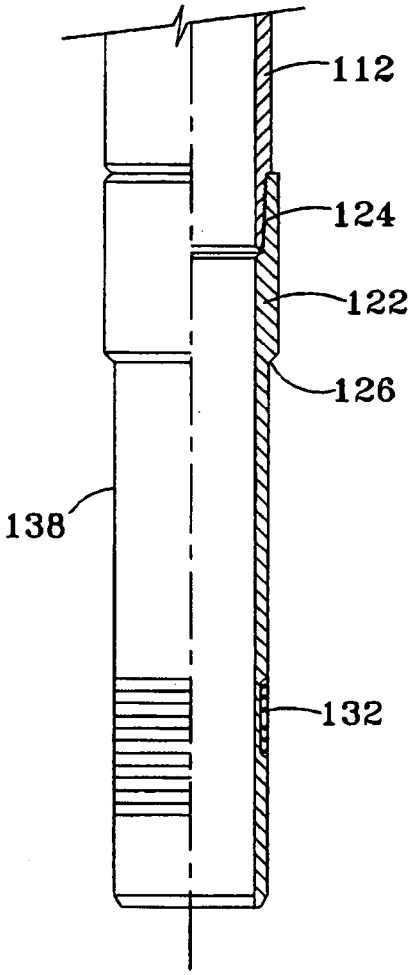
FIG. 5 illustrates a suitable seal nipple on the lower end of a production string for sealingly engaging the sealing sleeve shown in FIG. 4.

The tubular expander 70 may include shoulder 73 to optionally limit movement of the tubular expander 70 in the tubular anchor 72 upon engagement with end surface 52 on the anchor 72. The end surface 49 on the tubular expander may also engage shoulder 43 on the anchor to form the primary axial stop between the anchor and the expander. The lower portion of the tubular expander 70 may be positioned within the tubular anchor 72 to expand the tubular anchor 72, while the upper sealing sleeve 46 integral with the tubular expander 70 above the shoulder 94 may be used for sealing with a seal nipple 122 for connecting to a production string 112, as shown in FIGS. 5 and 6.

Figure 4:
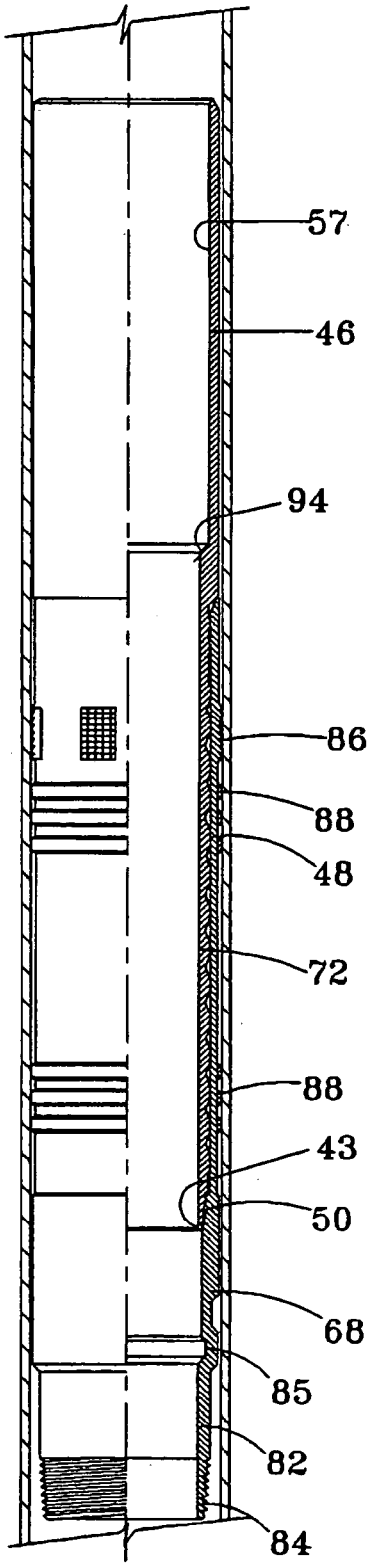
FIG. 4 illustrates the expander sleeve moved axially within the tubular anchor and the running tool retrieved.

FIG. 4 shows the tubular anchor 72 fully expanded against the casing string 12, with the tubular expander 70 inserted into the tubular anchor 72 down to the shoulder 43 on the anchor 72. The packer seals 88 are sealed against the casing string 12, and the slips 86 are in gripping engagement with the casing string 12.

Figure 6:
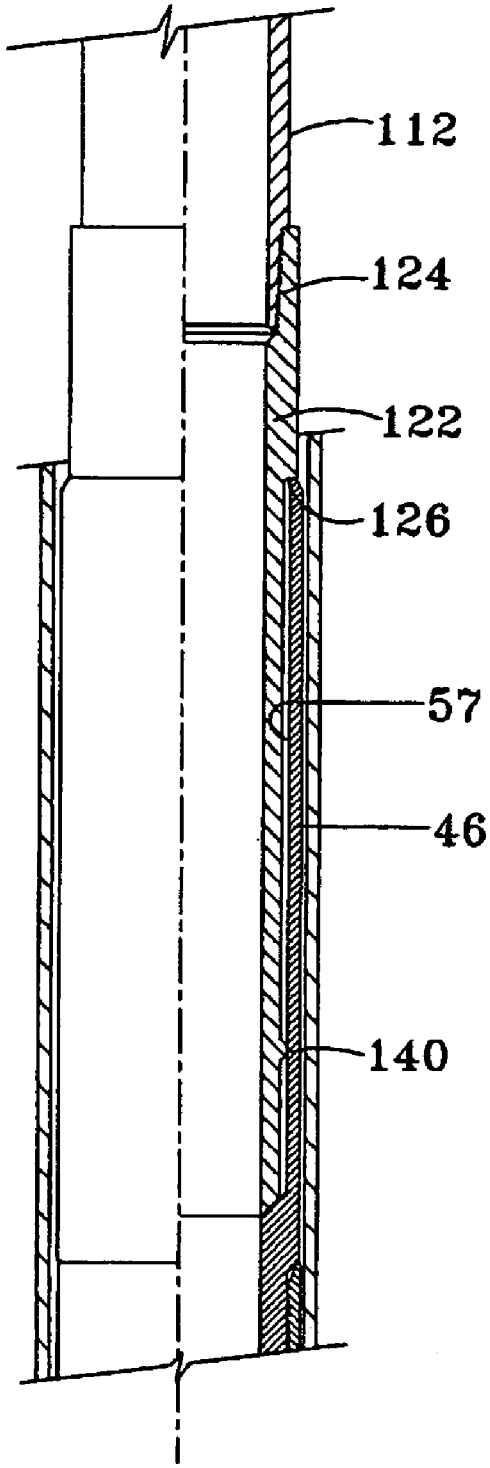
FIG. 6 illustrates an alternative seal nipple for end of an upper patch body in sealing engagement with a sealing sleeve at the upper end of a lower patch body.

With the tubular expander 70 moved fully within the tubular anchor 72 and the tubular anchor 72 expanded against the casing string 12, the running tool actuator assembly 10 may be removed, and the seal nipple 122 then installed, as shown in FIG. 6. The production tubing string 112 is joined in fluid communication with the seal nipple 122, such as with threaded connection 124. Alternatively, the production tubing string 112 could be joined with the seal nipple 122, for example, with a press-fit connection or an elastomeric seal. Those skilled in the art will appreciate that a central patch body may replace the production tubing string 112 when forming a patch in a casing string.

The seal nipple 122 may be inserted into the upper sealing sleeve portion 46 of the tubular expander 70, and may be inserted until shoulder 126 of the seal nipple 122 contacts the upper end of the sealing sleeve 46. The lower end of the seal nipple may also engage shoulder 94 on the expander 70 when the sealing nipple is fully inserted into the expander. The sealing sleeve 46 of the tubular expander 70 may be an upwardly extending sealing sleeve preferably integral with the upper end of expander 70 for sealing with the seal nipple 122. The sealing sleeve 46 preferably has a polished cylindrical inner surface 57 for sealing with a cylindrical outer surface 138 of the seal nipple. Alternatively, the sealing sleeve could have a polished cylindrical outer surface for sealing with a cylindrical inner surface of the seal nipple. The seal nipple 122 may also include an elastomeric seal 132, such as a Chevron seal stack for sealing with the cylindrical inner surface 57 of the sealing sleeve 46. Seal nipple 122 may also be furnished with one or more external metal-to-metal ball seals 140, as shown in FIG. 6, for sealing engagement with inner surface 57 of sealing sleeve 46.

It is a feature of the invention that the sealing sleeve and the seal nipple form an expansion joint that allows for thermal expansion and contraction of the tubular string or the tubular patch above the seal nipple. A related feature of the invention is that the seal nipple and sealing sleeve at the upper end of the tubular expander may function as a big bore production packer. The internal diameter of the sealing nipple and the tubular above the sealing nipple may thus be substantially the same as the internal diameter of the tubular expander radially within the tubular anchor.

A further feature of the invention is that additional patch systems may be provided extending uphole from the upper patch body. Another sealing sleeve 46 as shown in FIG. 6 may thus be attached to the upper tubular expander, and another sealing nipple 122 sealed to the upper sealing sleeve 46 with a further tubular 112, such as another patch body, extending upward from the upper sealing nipple. One or more additional anchors and tubular expanders provided above the upper expander may thus form further patches extending upward in the well. The patch as shown in FIG. 6 may thus be connected at its lower end to a lower patch body by threads, such as threads 84 shown in FIG. 4, and an upper patch body 112 and a higher patch then may form a second tubular patch in the well. A related feature of the invention is that the lower tubular anchor and tubular expander may be set in the well and the sealing integrity of lower patch body and the casing tested before running in the patch body or the upper anchor and upper expander. In the event a reliable fluid seal is not obtained, another tubular anchor and tubular expander may be positioned downhole directly above the initially set anchor, and once the sealing integrity of this assembly has been verified, the sealing nipple may be connected to the upwardly extending sealing sleeve of the second patch body.

FIG. 6 shows a sealing sleeve 46 of an upper tubular patch body, with a sealing sleeve 122 installed in the sealing sleeve. An upper tubular patch body 112 may extend upward from the upper tubular patch body, and another tubular patch body provided above the structure shown in FIG. 6 performing a second patch in a well. FIG. 6 also depicts an alternative sealing nipple wherein a annular bead 140 forms a metal-to-metal seal with the internal polished bore of the sealing sleeve the press fit connection between the ball seal 140 and the sealing sleeve 46 thus forms a reliable fluid type seal between the tubular expander and the sealing nipple. FIG. 6 also illustrates a significant feature of the invention, namely that the largest practical size tubular extending upward from the patch body, whether a production tubing string or a tubular patch, has a tubular ID which is not restricted by either the tubular expander or the anchor of the patch body. As shown in FIG. 6, the assembly may be used as a production packer and thus provides "full bore" capability with the largest size tubular which can practically be inserted within the casing. Similarly, upper and lower tubular patch bodies installed at the upper and lower end of a large diameter tubular patch does not restrict the full bore capability of the tubular patch. This feature is particularly important since tools which may subsequently be inserted into the well and down past the tubular patch or production packer will not likely get hung up on the tubular anchor or expander due to the full bore feature of the invention.

The production tubing string 112, like the casing string 12, may be assembled from multiple tubular members as is common in the art. The production tubing string 112 conventionally extends upwardly to the surface. Hydrocarbons may thus be transported from the formation, into the casing string 12, through the seal nipple 122, and through the production tubing string 112 to produce fluids from the well. Alternatively, fluid may be pumped down the tubing string, past the patch body, and into the casing or a formation below the patch body.

After the running tool strokes under fluid pressure and the tubular anchor 72 is expanded against the casing, sufficient forces are developed by the running tool to release the running tool 10 from the set expanded tubular anchor. The work string may then be raised to the surface, lifting the running tool from engagement with the tubular anchor and inner expander forming the lower patch seal. The upper patch seal may subsequently be set in a similar manner. The same actuator assembly may be used in multiple applications with suitable upper and lower expander bodies, and preferably also with upper and lower expander setting sleeves remaining downhole within the respective expanded tubular body.

A significant advantage of the present invention is that the running tool need not span the length between the top seal of a tubular patch and the bottom seal of the tubular patch. When a tool extends between the top and bottom expanded tubular bodies, the tool may be activated to expand a lower portion of the patch and form the lower seal simultaneous with the expansion of the upper end of the patch to form the upper seal. Most importantly, a tool that spans the length of the patch may itself grow axially a substantial length, so that axial growth or stretch of the tool is "made up" by stroking the tool until the top expander setting sleeve expands the top expander body at the upper end of the patch and the bottom expander setting sleeve expands engages the lower expander body at the lower end of the patch.

In order to form a reliable seal, a hydraulic setting tool as disclosed herein may be used for axially moving the lower expander body a relatively short distance of, e.g., 6" to 12", while forming a reliable fluid-tight seal between the lower anchor body and the casing string, and separately grippingly engaging the upper expander body with the casing string. All thermal connections of the liner between the upper and lower anchor bodies are desirably placed in compression. Also, the seal nipple and sealing sleeve serve as an expansion joint. A tool that simultaneously moves a lower expander sleeve axially upward and an upper expander sleeve axially downward, each movement requiring an average axial stroke of 9", thus requires a stroke length of 18". As a practical matter, however, the required stroke length of a hydraulic setting tool may need to be 40" or more, depending upon the length of the patch, and in excess of 20" of stroke length may be used to make up the axially grown tool. According to the present invention, the running tool may only require a stroke length of 9" to reliably expand the lower anchor body with a lower expander body, and the running tool may then be returned to the surface and the same running tool then used to expand the upper anchor body with the upper expander body. The same operation may thus be performed with a hydraulic running tool having a stroke length of 9, rather than the significantly longer stroke length required for a tool that spans the length of the patch.

Those skilled in the art will appreciate that the running tool of the present invention may also be used in various applications for expanding the diameter of a downhole tubular. Only a portion of a downhole tubular may be expanded, e.g., to assist in closing off a water zone from hydrocarbon zones above and below the water zone.

The method of the present invention significantly simplifies both the tool and the process used to reliably set a patch in a well. The process of the invention also, however, contradicts conventional wisdom for oil patch operations, which stress the importance of performing an operation in one trip, if possible, rather than two trips into and out of the well. The method of this invention utilizes one trip for sealing the lower expander body at the lower end of the patch, and another trip for sealing the upper expander body at the upper end of the patch. This operation significantly improves the reliability of the system and in many applications will be worth the additional trip costs.

A practical, representative approach to operating the fluid production assembly may be illustrated by the following sequence of steps:

1. Adequately clean inside surface of casing over patch interval and run full gauge drift simulating patch body;

2. Using screens or filters on pumps, circulate well clean from 100 ft. below point lower patch body is to be set;

3. Run casing/tubing caliper and collar locator through setting area of patch;

4. Assure that setting ball and seat are properly positioned and pinned in setting tool;

5. If tail pipe is to be extended from lower patch body, make-up and run required tail pipe and hang-off in slips at surface-otherwise proceed to Step 11;

6. Make-up lower patch body to tail pipe;

7. Position receptacle expander over lower end of setting tool;

8. Pick-up setting tool and stab into patch body until collet of setting tool has engaged running profile in patch body;

9. Raise setting tool to ensure engagement of collet in profile and adjust setting sleeve of setting tool to take-up any slack between receptacle expander and patch body—set slips on setting tool handling nipple;

10. Make-up setting tool to workstring;

11. If Step 5 above is not required, position patch receptacle/expander over lower end of setting tool and install patch body over setting tool until collet of tool has engaged running profile in patch body and adjust setting sleeve of setting tool to take-up any slack between receptacle/expander and patch body—make-up setting tool to work string;

12. Pick-up work string with setting tool and patch assembly and lower assembly through BOP exercising extreme care to avoid damage to sealing elements;

13. Run required length of work string to position patch at required depth and set slips on work string at surface;

14. Fill tubing slowly with fluid and make-up pressure/data port Header to work string;

15. Connect pump outlet line between pump and pressure/data port—connect input line to pump;

16. Connect pressure transducer to pressure/data port header and extend conductor line to data acquisition unit;

17. Apply pressure at controlled rate and monitor continuously to ensure required setting force to set patch;

18. Release setting tool with right hand rotation of work string or alternatively release setting tool by increasing pressure to break setting tool shear ring;

19. Pull work string and setting tool from well;

20. Inspect, clean, re-configure and dress setting tool, assuring that setting ball and seat are properly installed and re-pinned;

21. Run test seal nipple to pressure test lower patch assembly, or test patch with the setting tool after the patch is set to avoid a trip to test the lower patch;

22. Install lift nipple in top of first joint of liner and suspend over well;

23. Make-up seal nipple to the bottom of the first joint of liner and lower into well—attach safety clamp before setting slips and releasing elevators;

24. Continue to make-up additional joints of flush joint liner required to properly position the upper patch body when the seal nipple engages the receptacle of the patch previously run and lower into well using lift nipples and installing safety clamps on every joint until the liner is run—observe well for flow continually while running liner;

25. Make-up patch body to liner;

26. Repeat Steps 8 and 9;

27. Run required length of work string to position seal nipple at top of the previously run patch assembly;

28. Slowly lower work string until bottom of seal nipple contacts the top of the receptacle—slack-off required weight to fully engage seal nipple within receptacle and pick-up work string sufficiently to place liner in tension or neutral position (assembly may also be raised to move seal nipple off bottom of receptacle to accommodate liner expansion)—set slips on work string at surface;

29. Repeat Steps 14 through 19;

30. Close BOP, braden head or frac valve and bull head test for required pressure and time.

While preferred embodiments of the present invention have been illustrated in detail, it is apparent that other modifications and adaptations of the preferred embodiments will occur to those skilled in the art. However, it is to be expressly understood that such modifications and adaptations are within the spirit and scope of the present invention, which is defined in the following claims.

The invention claimed is:

1. A fluid production assembly for use downhole in a wellbore to seal with a casing string and transmit fluid between the casing string and a production string extending upward from the fluid production assembly, the fluid production assembly comprising:

a tubular anchor removably supportable on a running tool for positioning the tubular anchor downhole, the tubular anchor having an initial anchor inner diameter, and having an initial anchor outer diameter less than an inner diameter of the casing string, the tubular anchor being expandable by the running tool to seal with the casing string;

a tubular expander removably supportable on the running tool, the tubular expander having an expander outermost diameter greater than the initial anchor inner diameter;

the running tool including an actuator for forcibly moving the tubular expander axially from a position substantially axially spaced from the tubular anchor to a position substantially within the tubular anchor, thereby radially expanding the tubular anchor against the casing string to secure the tubular expander and the tubular anchor downhole;

a sealing sleeve secured to an upper end of the tubular expander and fluidly connecting the casing string, the tubular expander, and through the sealing sleeve; and a seal nipple for sealing with a bore of the sealing sleeve and fluidly connecting the sealing sleeve and the production string.

2. A fluid production assembly as defined in claim 1, wherein the seal nipple includes an annular metal bump extending radially outward from its outer surface for sealingly engaging the bore of the sealing sleeve.

3. A fluid production assembly as defined in claim 1, wherein the sealing sleeve includes a polished cylindrical surface for sealing with the seal nipple.

4. A fluid production assembly as defined in claim 1, further comprising:

an internal diameter of the tubular expander is substantially equal to an internal diameter of the production string, such that the tubular expander does not restrict a full bore feature of the production string.

5. A fluid production assembly as defined in claim 1, wherein the lower end of the running tool engages the tubular anchor to restrict axial movement of the tubular anchor when moving the tubular expander axially into the tubular anchor.

6. A fluid production assembly as defined in claim 5, wherein the running tool supports the tubular expander at an upper end of the tubular anchor when running in the well.

7. A fluid production assembly as defined in claim 1, wherein the tubular expander is sealed to the tubular anchor by a plurality of annular bumps on an outer surface of the tubular expander.

8. A fluid production assembly as defined in claim 1, wherein:

the tubular expander has a generally cylindrical exterior surface along an axial length of the tubular expander, such that the tubular anchor is expanded the same amount along the axial length of the tubular expander.

9. A fluid production assembly as defined in claim 6, wherein:

an outer surface of the tubular expander includes a tapered end spaced from the generally cylindrical surface, whereby the tapered end is partially inserted into the tubular anchor prior to expanding the tubular anchor; and an inner surface of the tubular anchor includes a tapered inner surface for receiving the tapered end of tubular expander prior to expansion.

10. A fluid production assembly as defined in claim 1, wherein a stop on the tubular anchor limits axial movement of the tubular expander with respect to the tubular anchor.

11. A fluid production assembly as defined in claim 1, further comprising:

one or more packer seals on the tubular anchor for sealing with the casing string upon expansion of the tubular anchor.

12. A fluid production assembly as defined in claim 1, further comprising:

a plurality of slips fixed on the tubular anchor for securing the tubular anchor to the casing string when the tubular anchor is expanded by the tubular expander.

13. A fluid production assembly for use downhole in a wellbore to seal with a casing string and transmit fluid between the casing string and a tubular patch within the casing string, the fluid production assembly comprising:

a lower tubular anchor removably supportable on a running tool for positioning the lower tubular anchor downhole, the lower tubular anchor having an initial lower anchor inner diameter, and having an initial lower anchor outer diameter less than an inner diameter of the casing string, the lower tubular anchor being expandable by the running tool to seal with the casing string;

a lower tubular expander removably supportable on the running tool, the lower tubular expander having a lower expander outermost diameter greater than the initial anchor inner diameter;

an upper tubular anchor removably supportable on a running tool for positioning the upper tubular anchor downhole, the upper tubular anchor having an initial upper anchor inner diameter, and having an initial upper anchor outer diameter less than the inner diameter of the casing string, the upper tubular anchor being expandable by the running tool to seal with the casing string;

an upper tubular expander removably supportable on the running tool, the upper tubular expander having an upper expander outermost diameter greater than the initial anchor inner diameter;

the running tool including an actuator for forcibly moving each tubular expander axially from a position substantially axially spaced from the respective tubular anchor to a position substantially within the respective tubular anchor, thereby radially expanding the respective tubular anchor against the casing string to secure the respective tubular expander and the respective tubular anchor downhole;

a sealing sleeve secured to an upper end of the lower tubular expander fluidly connecting the casing string, the lower tubular expander, and the sealing sleeve;

a seal nipple for sealing with a bore of the sealing sleeve and fluidly connecting the sealing sleeve and the tubular patch; and an upper end of the tubular patch being sealed to the upper tubular anchor.

14. A fluid production assembly as defined in claim 13, wherein the seal nipple includes an annular metal bump extending radially outward from its outer surface for sealingly engaging the bore of the sealing sleeve.

15. A fluid production assembly as defined in claim 13, wherein:

the lower tubular expander has a generally cylindrical exterior surface along an axial length of the lower tubular expander, such that the lower tubular anchor is expanded the same amount along the axial length of the lower tubular expander.

16. A fluid production assembly as defined in claim 15, wherein:

the upper tubular expander has a generally cylindrical exterior surface along an axial length of the upper tubular expander, such that the upper tubular anchor is expanded the same amount along the axial length of the upper tubular expander.

17. A fluid production assembly as defined in claim 13, further comprising:

an internal diameter of the lower tubular expander is substantially equal to an internal diameter of the tubular patch, such that the lower tubular expander does not restrict a full bore feature of the tubular patch.

18. A fluid production assembly as defined in claim 13, wherein the lower end of the running tool engages the respective tubular anchor to restrict axial movement of the respective tubular anchor when moving the respective tubular expander axially into the respective tubular anchor.

19. A fluid production assembly as defined in claim 13, wherein the running tool supports the respective tubular expander at an upper end of the respective tubular anchor when running in the well.

20. A fluid production assembly as defined in claim 13, wherein the respective tubular expander is sealed to the respective tubular anchor by a plurality of annular bumps on an outer surface of the respective tubular expander.

21. A fluid production assembly as defined in claim 13, wherein a stop on respective tubular anchor limits axial movement of the respective tubular expander with respect to the respective tubular anchor.

22. A fluid production assembly as defined in claim 13, further comprising:

one or more packer seals on the respective tubular anchor for sealing with the casing string upon expansion of the tubular anchor; and a plurality of slips fixed on the respective tubular anchor for securing the respective tubular anchor to the casing string when the respective tubular anchor is expanded by the respective tubular expander.

23. A method of sealing with a casing string to transmit fluid between the casing string and a tubular extending upward from the casing string, comprising:

positioning an expandable tubular anchor and tubular expander on a running tool, the tubular anchor having an initial anchor inner diameter, and an initial anchor outer diameter less than an inner diameter of the casing string, the tubular expander having an expander outermost diameter greater than the initial anchor inner diameter, and a sealing sleeve secured to an upper end of the tubular expander;

positioning the running tool at a selected depth within a wellbore;

actuating the running tool to forcibly move the tubular expander axially to a position substantially within the tubular anchor to radially expand the tubular anchor against the casing string, thereby securing the tubular anchor and the tubular expander downhole; and fluidly connecting a seal nipple to the sealing sleeve.

24. A method as defined in claim 23, further comprising:

providing a plurality of axially spaced radial projecting annular bumps on an outer surface of the tubular expander.

25. A method as defined in claim 23, further comprising:

positioning one or more packers seals on the tubular anchor for expanding with the tubular anchor to seal the tubular anchor with the casing string.

26. A method as defined in claim 23, further comprising:

fixing a plurality of slips on the tubular anchor for expanding with the tubular anchor to engage the slips with the casing string to secure the tubular anchor within the casing string.

27. A method as defined in claim 23, further comprising:

positioning the tubular expander above the tubular anchor prior to forcibly moving the tubular expander substantially within the tubular anchor.

28. A method as defined in claim 23, further comprising:

sealingly connecting a production tubing string to the seal nipple.

29. A method as defined in claim 28, further comprising:

forming a metal-to-metal ball seal on the seal nipple for sealing with the sealing sleeve.

30. A method as defined in claim 29, further comprising:

sealing connecting a tubular patch and a seal nipple to the upper tubular expander; and positioning an expandable upper tubular anchor and another tubular expander at the upper end of the tubular patch.

31. A method as defined in claim 29, further comprising:

sealing connecting a tubular patch and a seal nipple to the upper tubular expander; and positioning an expandable tubular anchor and another tubular expander at the upper end of the another tubular patch.

32. A method as defined in claim 23, further comprising:

an internal diameter of a tubular expander is substantially equal to an internal diameter of the tubular, such that the tubular expander does not restrict a full bore feature of the tubular.

33. A method as defined in claim 23, further comprising:

interconnecting a lower end of the running tool with the tubular anchor prior to moving the tubular expander axially into the tubular anchor.

34. A method as defined in claim 23, further comprising:

testing sealing integrity between the tubular anchor and the casing string prior to running the tubular patch in the well to seal with the tubular expander.

* * * * *